US009194166B1

(12) United States Patent
Spiegel et al.

(10) Patent No.: US 9,194,166 B1
(45) Date of Patent: Nov. 24, 2015

(54) MODIFIED DOOR HINGE COMPRISING LOCKING MECHANISM

(71) Applicants: Peter H Spiegel, Palm Springs, CA (US); Lori Kirshner, Palm Springs, CA (US)

(72) Inventors: Peter H Spiegel, Palm Springs, CA (US); Lori Kirshner, Palm Springs, CA (US)

( * ) Notice: Subject to any disclaimer, the term of this patent is extended or adjusted under 35 U.S.C. 154(b) by 0 days.

(21) Appl. No.: 14/271,430

(22) Filed: May 6, 2014

Related U.S. Application Data

(60) Provisional application No. 61/820,062, filed on May 6, 2013.

(51) Int. Cl.
*E05D 11/10* (2006.01)
*E05D 3/02* (2006.01)

(52) U.S. Cl.
CPC ..... *E05D 11/1007* (2013.01); *E05D 3/02* (2013.01)

(58) Field of Classification Search
CPC ..... E05D 11/06; E05D 11/10; E05D 11/1007; E05D 11/1014
USPC ..... 16/319, 348, 357, 358, 374, 386, 387
See application file for complete search history.

(56) References Cited

U.S. PATENT DOCUMENTS

| | | | | | |
|---|---|---|---|---|---|
| 1,484,536 | A * | 2/1924 | Way | 16/242 |
| 1,683,814 | A * | 9/1928 | Block | 16/353 |
| RE17,292 | E * | 5/1929 | Regan | 16/374 |
| 3,538,539 | A * | 11/1970 | Allison | 16/375 |
| 4,603,452 | A * | 8/1986 | Paciorek | 16/262 |
| 5,048,155 | A * | 9/1991 | Hwang | 16/301 |
| 6,353,967 | B1 * | 3/2002 | Escobar et al. | 16/331 |
| 6,460,220 | B1 * | 10/2002 | Jackson | 16/285 |
| 7,296,832 | B1 * | 11/2007 | Campbell | 292/292 |
| 8,307,513 | B1 * | 11/2012 | Fitzgerald | 16/386 |

* cited by examiner

*Primary Examiner* — Roberta Delisle
(74) *Attorney, Agent, or Firm* — Loza & Loza, LLP; S. Sean Thavonekham

(57) ABSTRACT

Some implementations provide a hinge that includes a first wing, a second wing, a coupling pin, and a locking pin. The first wing includes a first knuckle and a second knuckle. The first knuckle includes a first hole. The second knuckle includes a second hole and a first locking hole. The second wing includes a third knuckle and a fourth knuckle. The third knuckle includes a third hole. The fourth knuckle includes a fourth hole. The coupling pin is configured to couple the first wing to the second wing through the first, second, third and fourth knuckles. The locking pin configured to limit the hinge in a particular position when the locking pin is inserted into the first locking hole of the second knuckle. The locking pin configured to lock the hinge in a particular position when the locking pin is inserted into the locking hole of the second knuckle.

19 Claims, 18 Drawing Sheets

MODIFIED DOOR HINGE COMPRISING LOCKING MECHANISM

The present application claims priority to U.S. Provisional Application No. 61/820,062, entitled "Modified Door Hinge Locking Mechanism", filed May 6, 2013, which is hereby expressly incorporated by reference herein.

BACKGROUND

1. Field of Invention

At least one feature pertains to a modified door hinge with locking mechanism.

2. Background of Invention

A door is an entryway into a room. A door can pivot about a frame through one or more hinges, which allows the door to be opened and closed. FIG. 1 illustrates an example of a door. Specifically, FIG. 1 illustrates a door 100 that is coupled to a frame 108 through several hinges (e.g., first hinge 102, second hinge 104, and third hinge 106). As mentioned above, these hinges 102-106 allow the door 100 to pivot and thereby allow the door 100 to open and close. As shown in FIG. 1, the hinge 102 includes several components, including a first set of knuckles 110, a second set of knuckles 112 and a pin 114.

FIG. 2 illustrates a more detailed example of a conventional hinge used to couple a door to a frame (e.g., wall). As shown in FIG. 2, the hinge 200 includes a first wing 202, a second wing 204 and a pin 206. The first wing 202 includes several knuckles that have holes in them. The second wing 204 also includes several knuckles that have holes in them as well. The first wing 202 is a door wing that is coupled to the door. The second wing 204 is a frame wing that is coupled to the frame. The first wing 202 and the second wing 204 may be coupled together through the pin 206. When the first wing 202 and the second wing 204 are coupled together, the pin 206 traverses through the holes in the knuckles of the first and second wings 202-204.

The door can be locked into a closed positioned through the use of locks/bolts that are located at near the handle of the door. In some instances, it may be desirable to leave the door ajar and/or slightly open. For example, it may be desirable to leave a door slightly open so that a pet (e.g., dog) can go in and out of a room, while preventing another pet (e.g., another larger dog) from entering the room. Typically, to secure/lock the door in a slightly ajar position and/or open position (e.g., slightly ajar from the closed position), an object is typically placed at the base of the door. For example, a wedge may be positioned at the base of the door to lock the door in an ajar/open position. However, the use of a wedge is often unreliable as it can be easily moved/removed. In addition, a wedge is aesthetically unpleasant.

As such there is a need for a locking mechanism that allows a user to secure/lock a door in an open/ajar position. Ideally, such a locking mechanism allows for variable/multiple locking positions.

SUMMARY

Various features, apparatus and methods described herein provide a modified door hinge with a locking mechanism.

A first example provides a hinge that includes a first wing, a second wing, a coupling pin, and a locking pin. The first wing includes a first knuckle and a second knuckle. The first knuckle includes a first hole. The second knuckle includes a second hole and a first locking hole. The second wing includes a third knuckle and a fourth knuckle. The third knuckle includes a third hole. The fourth knuckle includes a fourth hole. The coupling pin is configured to couple the first wing to the second wing through the first, second, third and fourth knuckles. The locking pin is configured to limit the hinge in a particular position when the locking pin is inserted into the first locking hole of the second knuckle.

According to an aspect, the locking pin is configured to lock the hinge in a particular position when the locking pin is inserted into the locking hole of the second knuckle.

According to an aspect, the first wing is a door wing and the second wing is a frame wing.

According to an aspect, the coupling pin includes at least one locking hole.

According to an aspect, the first wing further includes a fifth knuckle, the fifth knuckle comprising a fifth hole, wherein the fourth knuckle comprises a second locking hole. In some implementations, the locking pin includes a first protrusion and a second protrusion, the first protrusion is configured to be inserted in the first locking hole, the second protrusion configured to be inserted in the second locking hole.

A second example provides a hinge that includes a first wing, a second wing, a coupling pin, and a locking slab. The first wing includes a first knuckle and a second knuckle. The first knuckle includes a first hole and a first slot. The second knuckle includes a second hole. The second wing includes a third knuckle and a fourth knuckle. The third knuckle includes a third hole. The fourth knuckle includes a fourth hole. The coupling pin is configured to couple the first wing to the second wing through the first, second, third and fourth knuckles. The locking slab is configured to limit the hinge in a particular position when the locking slab is inserted into the first slot of the first knuckle.

According to an aspect, the locking slab is configured to lock the hinge in a particular position when the locking slab is inserted into the first slot of the first knuckle.

According to an aspect, the first wing is a door wing and the second wing is a frame wing.

According to an aspect, the second knuckle comprises a second slot, the third knuckle comprising a third slot. In some implementations, the locking slab is configured to lock the hinge in a particular position when the locking slab is inserted into the first slot, the second slot and the third slot.

According to an aspect, the coupling pin includes a pin slot, the locking slab being configured to limit the hinge in a particular position when the locking slab is inserted into the first slot of the first knuckle and the pin slot of the coupling pin.

According to an aspect, the coupling pin includes at least one locking hole.

DRAWINGS

Various features, nature and advantages may become apparent from the detailed description set forth below when taken in conjunction with the drawings in which like reference characters identify correspondingly throughout.

DETAILED DESCRIPTION

The following detailed description is of the best currently contemplated modes of carrying out the invention. The description is not to be taken in a limiting sense, but is made merely for the purpose of illustrating the general principles of the invention.

Overview

Some implementations provide a hinge that includes a first wing, a second wing, a coupling pin, and a locking pin. The first wing includes a first knuckle and a second knuckle. The first knuckle includes a first hole. The second knuckle includes a second hole and a first locking hole. The second wing includes a third knuckle and a fourth knuckle. The third knuckle includes a third hole. The fourth knuckle includes a fourth hole. The coupling pin is configured to couple the first wing to the second wing through the first, second, third and fourth knuckles. The locking pin is configured to limit the hinge in a particular position when the locking pin is inserted into the first locking hole of the second knuckle. In some implementations, the locking pin is configured to lock the hinge in a particular position when the locking pin is inserted into the locking hole of the second knuckle.

Exemplary Modified Hinges

Figure 1:
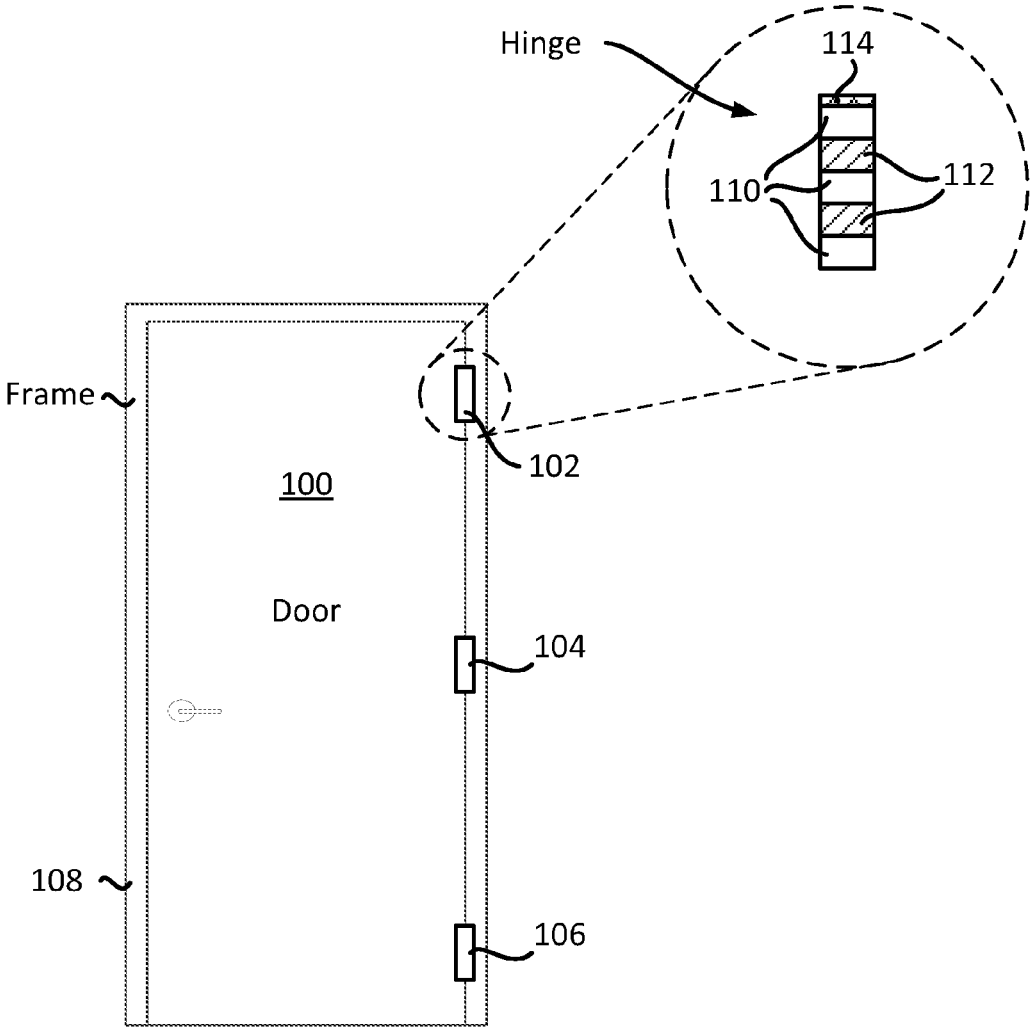
PRIOR ART FIG. 1
FIG. 1 illustrates a conventional door hinge on a door.
Figure 2:
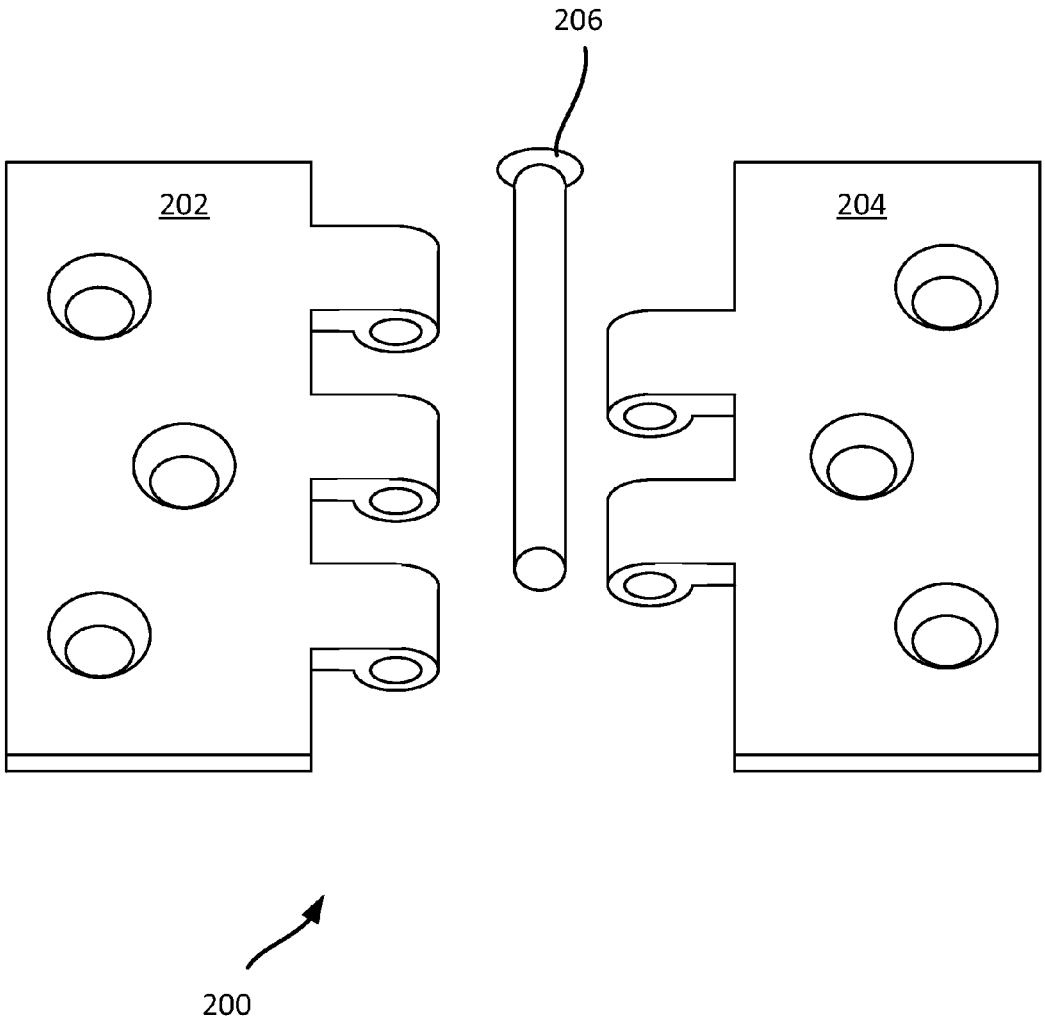
PRIOR ART FIG. 2
FIG. 2 illustrates another conventional door hinge.
Figure 3:
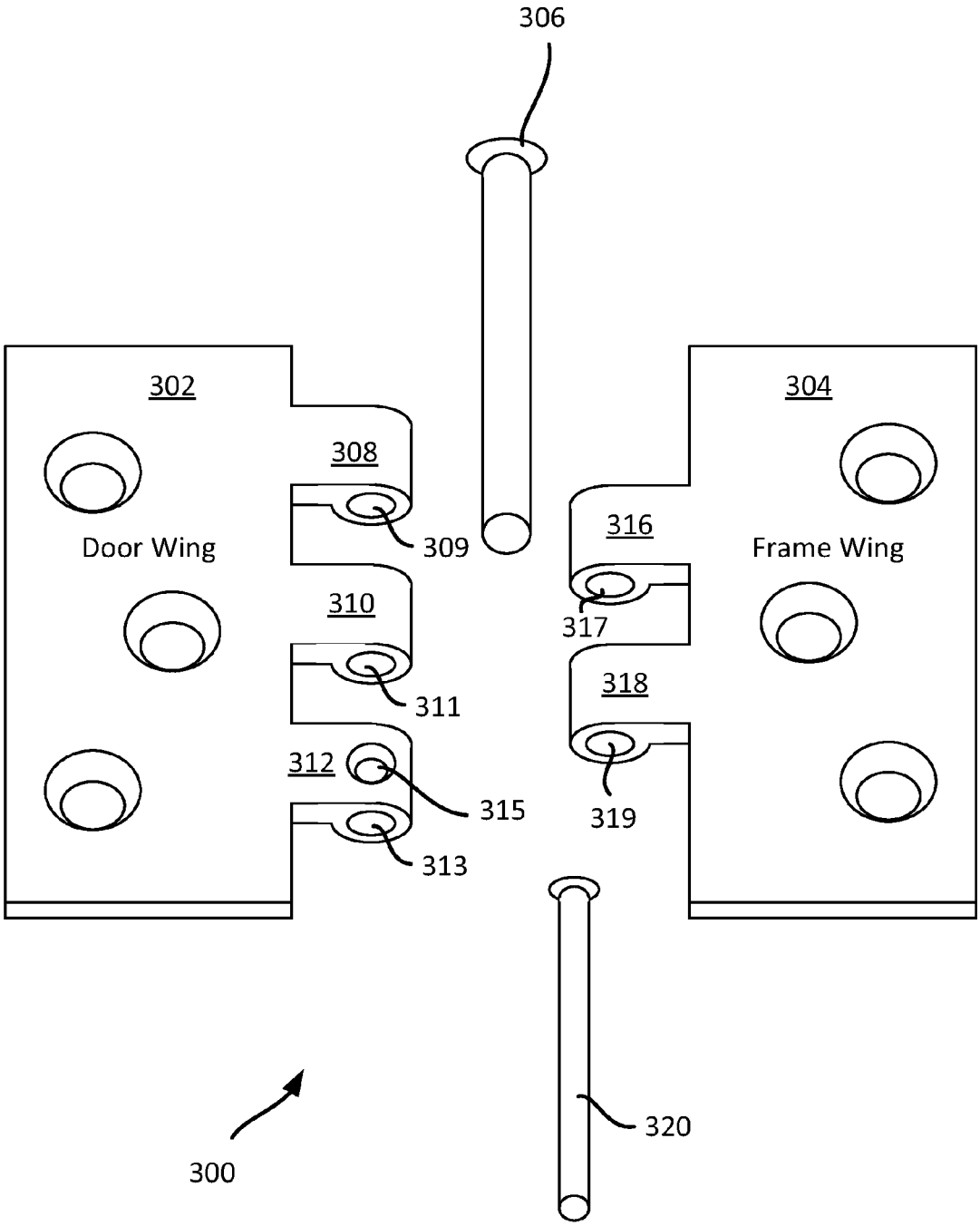
FIG. 3 illustrates an example of a modified hinge/hinge assembly that includes a mechanism for limiting the range/movement of a door.

FIG. 3 illustrates an example of a modified hinge/hinge assembly that includes a mechanism for limiting the range/movement of a door in some implementations. As shown in FIG. 3, the hinge/hinge assembly 300 includes a first wing 302, a second wing 304, and a pin 306.

In some implementations, the first wing 302 is a door wing that is coupled to a door. The first wing 302 is coupled to a first knuckle 308, a second knuckle 310, and a third knuckle 312. The first knuckle 308 includes a first hole 309 that traverses through a first direction (e.g., along the longitudinal direction) in the first knuckle 308. The second knuckle 310 includes a second hole 311 that traverses through the first direction (e.g., along the longitudinal direction) in the second knuckle 310. The third knuckle 312 includes a third hole 313 that traverses through the first direction (e.g., along the longitudinal direction) in the third knuckle 312. The third knuckle 312 also includes another third hole 315 that traverses through a second direction (e.g., along lateral direction) in the third knuckle 312. The second direction is different than the first direction.

In some implementations, the second wing 304 is a frame wing that is coupled to a frame. The second wing 304 is coupled to a fourth knuckle 316 and a fifth knuckle 318. The fourth knuckle 316 includes a fourth hole 317 that traverses through a first direction (e.g., along the longitudinal direction) in the fourth knuckle 316. The fifth knuckle 318 includes a fifth hole 319 that traverses through the first direction (e.g., along the longitudinal direction) in the fifth knuckle 318.

In some implementations, the pin 306 is a coupling pin that couples the first wing 302 with the second wing 304. Specifically, the pin 306 couples the first and second wings 302-304 by traversing through the holes 309, 317, 311 and 319 in some implementations. However, in some implementations, the pin 306 may traverse more or less holes. In some implementations, the pin 306 may include one or more holes (not shown). Examples of holes in a pin will be further described below.

To lock, secure, and/or limit the range of how much a door can be opened, a second pin 320 may be used. Specifically, in some implementations, the second pin 320 (which may be part of the hinge/hinge assembly 300), is inserted in the hole 315 to limit the range of how much a door can be opened. When the second pin 320 is inserted in the hole 315, the second pin 320 may prevent the door from fully opening (e.g., 90 degree open), since the second pin 320 may hit a frame/wall as the door is opened and the second pin 320 pivots towards the frame/wall. In some implementations, the length of the second pin 320 and/or the angle at which the pin 320 (e.g., angle of the hole 315 in the third knuckle 312) is inserted will determine how much a door can be opened. Thus, different implementations may have a hole (e.g., hole 315) in different positions/angles in a knuckle. Moreover, different knuckles may have different number of holes (e.g., more than one hole). In addition, the hole in which the pin is inserted may be located on a different wing.

Figure 4:
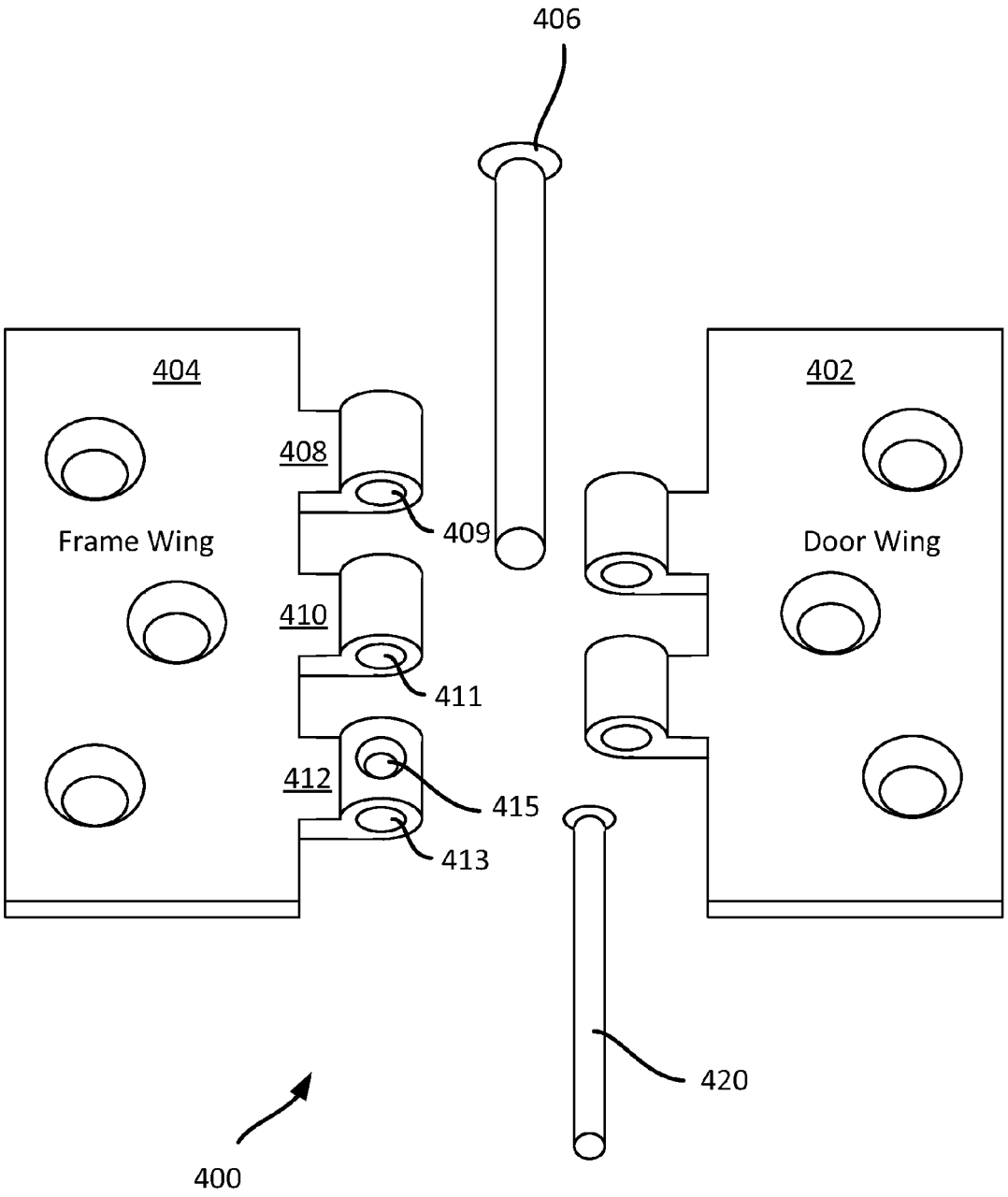
FIG. 4 illustrates an example of another hinge/hinge assembly that includes a mechanism for limiting the range/movement of a door.

FIG. 4 illustrates an example of another hinge/hinge assembly that includes a mechanism for limiting the range/movement of a door in some implementations. As shown in FIG. 4, the hinge/hinge assembly 400 includes a first wing 402, a second wing 404, a first pin 406, and a second pin 420.

The first wing 402 is a door wing that is coupled to a door. In some implementations, the second wing 404 is a frame wing that is coupled to a frame. The second wing 404 is coupled to a first knuckle 408, a second knuckle 410, and a third knuckle 412. The first knuckle 408 includes a first hole 409 that traverses through a first direction (e.g., along the longitudinal direction) in the first knuckle 408. The second knuckle 410 includes a second hole 411 that traverses through the first direction (e.g., along the longitudinal direction) in the second knuckle 410. The third knuckle 412 includes a third hole 413 that traverses through the first direction (e.g., along the longitudinal direction) in the third knuckle 412. The third knuckle 412 also includes another third hole 415 that traverses through a second direction (e.g., along lateral direction) in the third knuckle 412. The second direction is different than the first direction.

To lock, secure, and/or limit the range of how much a door can be opened, the second pin 420 may be used. Specifically, in some implementations, the second pin 420 is inserted in the hole 415 to limit the range of how much a door can be opened. As can be seen in FIG. 4, the location/angle of the hole 415 is different than the location of the hole 315 in FIG. 3. In some implementations, the pin 406 may include one or more holes (not shown). Examples of holes in a pin will be further described below.

Figure 5:
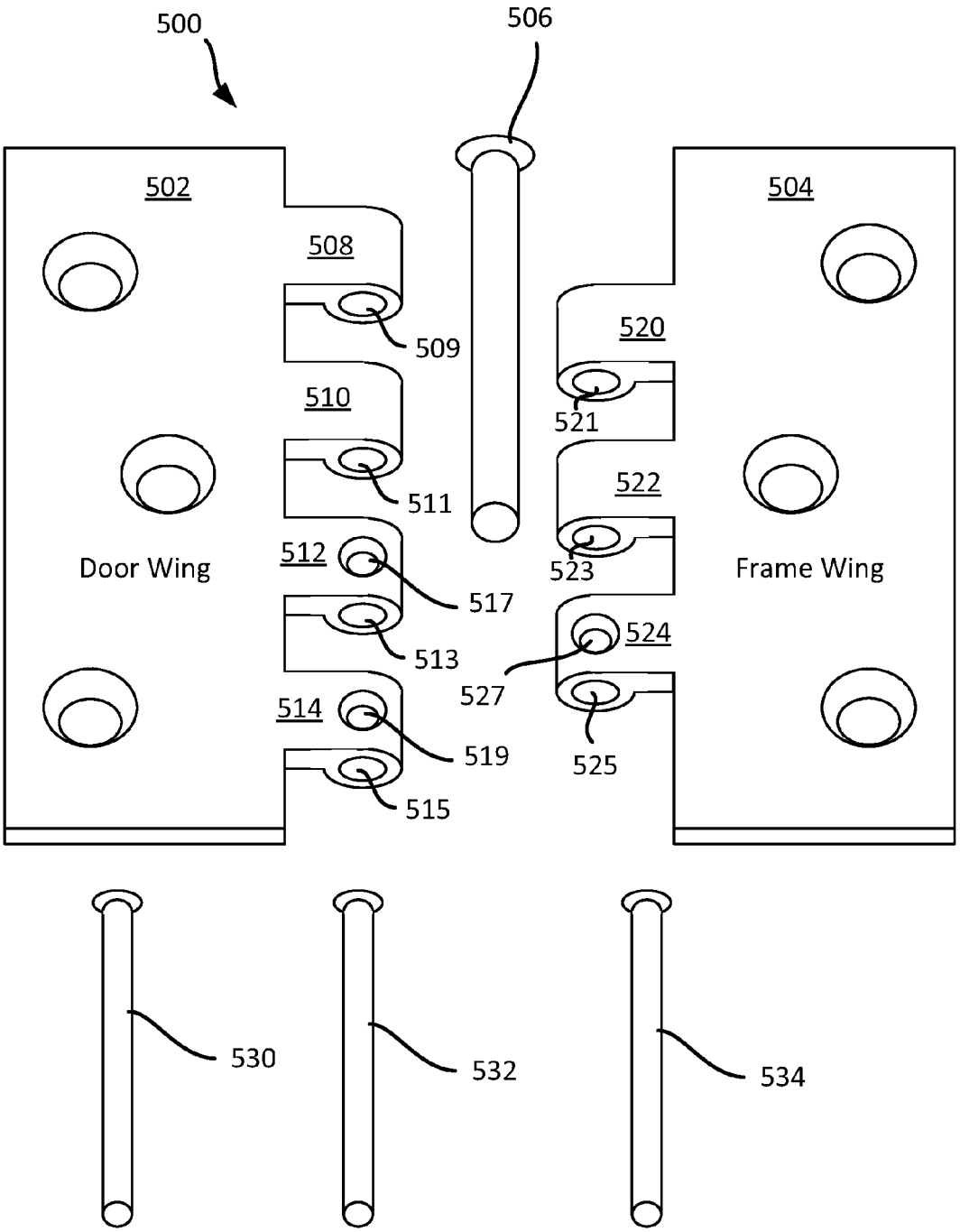
FIG. 5 illustrates another example of another hinge/hinge assembly that includes a mechanism for limiting the range/movement of a door.

In some implementations, a hinge assembly may include additional knuckles and holes. FIG. 5 illustrates such an example of a hinge/hinge assembly. As shown in FIG. 5, the hinge/hinge assembly 500 includes a first wing 502, a second wing 504, and a pin 506.

In some implementations, the first wing 502 is a door wing that is coupled to a door. The first wing 502 is coupled to a first knuckle 508, a second knuckle 510, a third knuckle 512 and a fourth knuckle 514. The first knuckle 508 includes a first hole 509 that traverses through a first direction (e.g., along the longitudinal direction) in the first knuckle 508. The second knuckle 510 includes a second hole 511 that traverses through the first direction (e.g., along the longitudinal direction) in the second knuckle 510. The third knuckle 512 includes a third hole 513 that traverses through the first direction (e.g., along the longitudinal direction) in the third knuckle 512. The third knuckle 312 also includes another third hole 517 that traverses through a second direction (e.g., along lateral direction) in the third knuckle 512. The second direction is different than the first direction. The fourth knuckle 514 includes a fourth hole 515 that traverses through the first direction (e.g., along the longitudinal direction) in the fourth knuckle 514. The fourth knuckle 514 also includes another fourth hole 519 that traverses through the second direction (e.g., along lateral direction) in the fourth knuckle 514.

In some implementations, the second wing 504 is a frame wing that is coupled to a frame. The second wing 504 is coupled to a fifth knuckle 520, a sixth knuckle 522, and a seventh knuckle 524. The fifth knuckle 520 includes a fifth hole 521 that traverses through the first direction (e.g., along the longitudinal direction) in the fifth knuckle 520. The sixth knuckle 522 includes a sixth hole 523 that traverses through the first direction (e.g., along the longitudinal direction) in the sixth knuckle 522. The seventh knuckle 524 includes a seventh hole 525 that traverses through the first direction (e.g., along the longitudinal direction) in the seventh knuckle 524. The seventh knuckle 524 also includes another seventh hole 527 that traverses through the second direction (e.g., along lateral direction) in the seventh knuckle 524.

Figure 6:
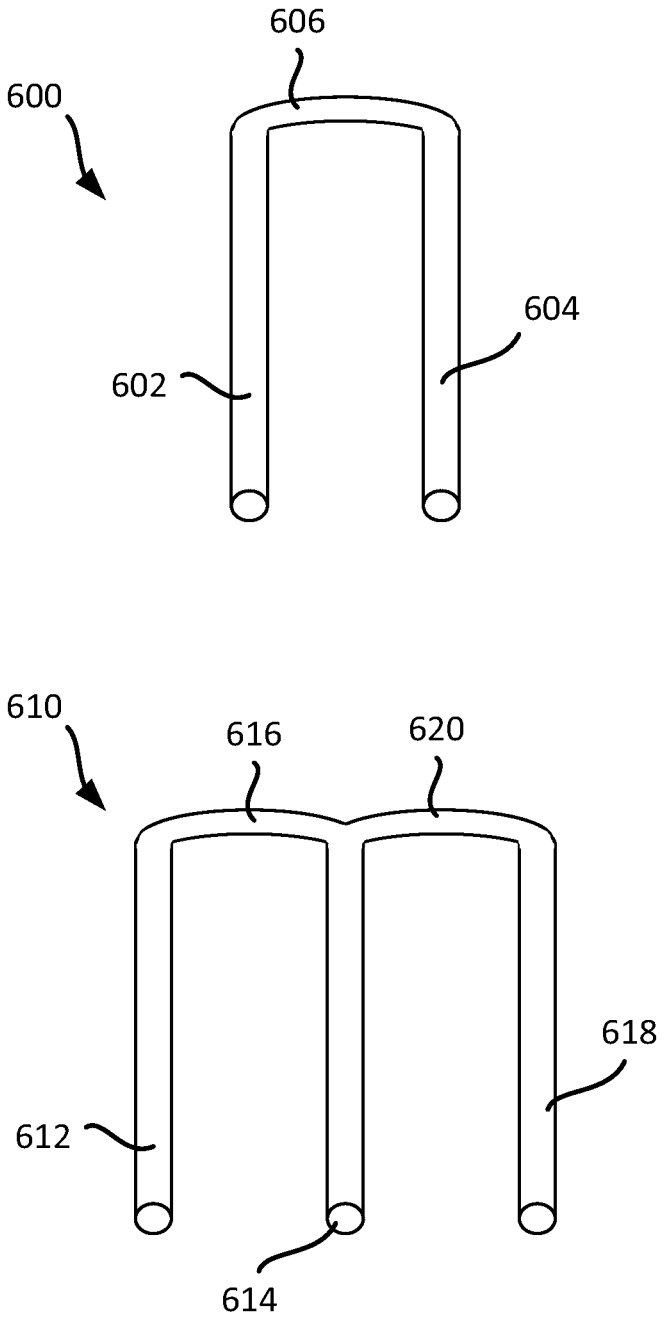
FIG. 6 illustrates examples of pins that may be used with the hinge/hinge assembly.

FIG. 5 also illustrates several pins 530-534. One or more of the pins 530-534 may be inserted in holes 517, 519, and/or 527 of FIG. 5 to lock, secure, and/or limit the range of how much a door can be opened. The pins 530-534 may be referred as locking pins in some implementations. In some implementations, different sets of pins may be used. FIG. 6 illustrates examples of other pins that may be used with the hinge/hinge assembly described in the disclosure. Specifically, FIG. 6 illustrates a first pin 600 and a second pin 610. The first and second pins 600 and 610 may be referred as locking pins in some implementations. The first pin 600 includes a first protrusion 602 and a second protrusion 604, which are coupled together through a connecting member 606. In some implementations, the first protrusion 602, the connecting member 606 and the second protrusion 604 are one single piece. In some implementations, the first protrusion 602 and the second protrusion 604 may be inserted in one of the holes described in FIG. 5. For example, the first protrusion 602 and the second protrusion 604 of the pin 600 may be inserted in holes 517, 519 and/or 527 of FIG. 5.

The second pin 610 includes a first protrusion 602, a second protrusion 614 and a third protrusion 618, which are coupled together through a first connecting member 616 and a second connecting member 620. In some implementations, the first protrusion 612, the first connecting member 616, the second protrusion 614, the second connecting member 620, and the third protrusion 618 are one single piece. In some implementations, the first protrusion 612, the second protrusion 614, and the third protrusion 618 may be inserted in one of the holes described in FIG. 5. For example, the first protrusion 612, the second protrusion 614, and the third protrusion 618 of the pin 610 may be inserted in holes 517, 519 and/or 527 of FIG. 5. Different implementations may have different sizes and shapes. For example, one or more of the locking pins may be straight, curved, and/or non-linear.

Having described various examples of hinges/hinge assemblies, a conceptual example of a hinge/hinge assembly under operating condition will now be described.

Figure 7A:
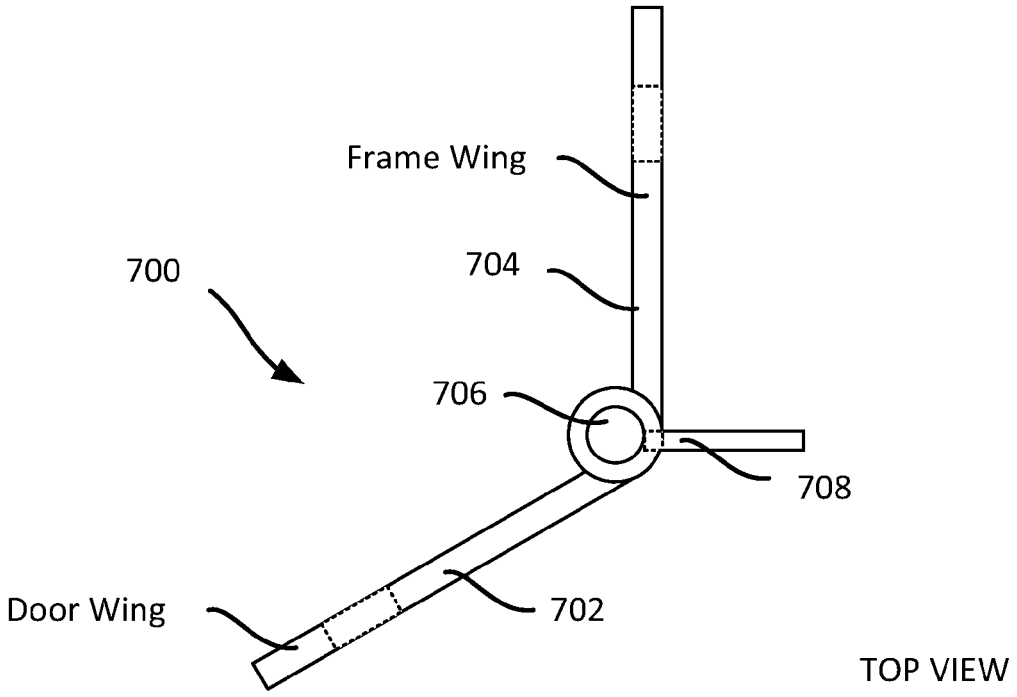
FIG. 7A illustrates a conceptual example of how a hinge/hinge assembly with a mechanism for locking, securing, and/or limiting the movement, position of a door operates.

FIG. 7A illustrates a conceptual example of how a hinge/hinge assembly with a mechanism for locking, securing, and/or limiting the movement, position of a door operates. Specially, FIG. 7A illustrates a plan view (e.g., top view) of a hinge 700 that includes a first wing 702, a second wing 704, a first pin 706, and a second pin 708. The hinge 700 also includes several knuckles (which are not visible). The hinge 700 may be any of the hinges (e.g., hinges 300, 400, 500, 600) described in the present disclosure. The first wing 702 may be a door wing that is coupled to a door. The second wing 704 may be a frame wing that is coupled to a frame. As shown in FIG. 7A, the first pin 706 traverses through a first set of holes in knuckles (not visible), which allow the first wing 702 to be coupled to the second wing 704. FIG. 7A also illustrates the second pin 708, which may be a locking pin, traversing through holes in knuckles (not visible). The second pin 708 may be any of the pins (e.g., locking pins) described in the present disclosure (e.g., pins 420, 600, 610). As shown in FIG. 7A, when the second pin 708 is inserted in one or more holes in the hinge/hinge assembly (e.g., knuckles), the second pin 708 provides a mechanism for locking/securing the door in a particular position and/or provides a limited range to open the door.

Figure 7B:
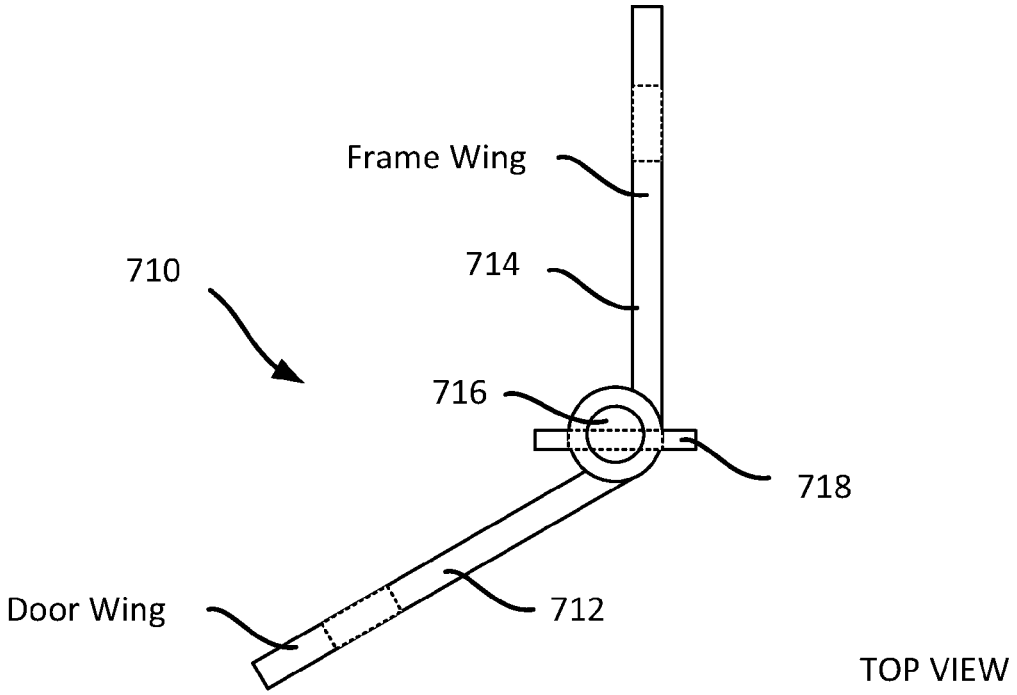
FIG. 7B illustrates another conceptual example of how a hinge/hinge assembly with a mechanism for locking, securing, and/or limiting the movement, position of a door operates.

FIG. 7B illustrates a conceptual example of how a hinge/hinge assembly with a mechanism for locking, securing, and/or limiting the movement, position of a door operates. Specially, FIG. 7B illustrates a plan view (e.g., top view) of a hinge 710 that includes a first wing 712, a second wing 714, a first pin 716, and a second pin 718. The hinge 710 also includes several knuckles (which are not visible). The hinge 710 may be any of the hinges (e.g., hinges 300, 400, 500, 600) described in the present disclosure. The first wing 712 may be a door wing that is coupled to a door. The second wing 714 may be a frame wing that is coupled to a frame. As shown in FIG. 7B, the first pin 716 traverses through a first set of holes in knuckles (not visible), which allow the first wing 712 to be coupled to the second wing 714. FIG. 7B also illustrates the second pin 718, which may be a locking pin, traversing through holes in knuckles (not visible) and a hole in the first pin 716. The second pin 718 may be any of the pins (e.g., locking pins) described in the present disclosure (e.g., pins 420, 600, 610). As shown in FIG. 7B, when the second pin 718 is inserted in one or more holes in the hinge/hinge assembly (e.g., knuckles), the second pin 718 provides a mechanism for locking/securing the door in a particular position and/or provides a limited range to open the door.

Figure 8A:
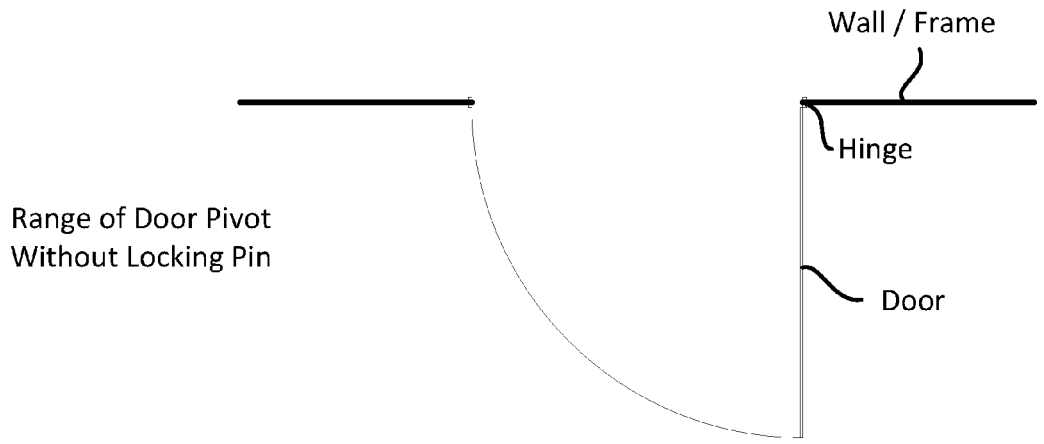
FIG. 8A illustrates an example of how open a door can be without a locking pin.
Figure 8B:
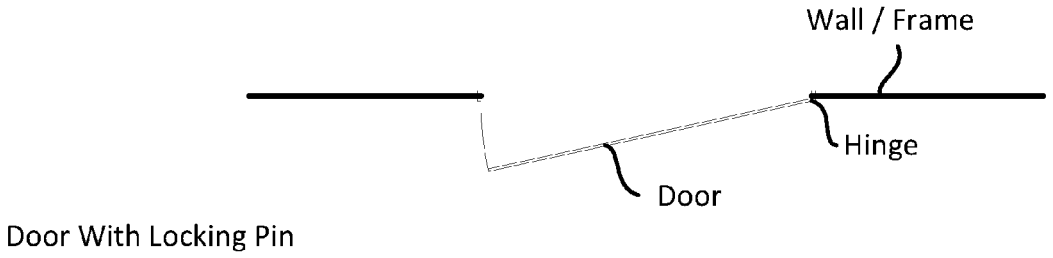
FIG. 8B illustrates an example of how a locking pin can limit, secure, and/or lock a door into a particular position.

FIG. 8A illustrates an example of how open a door can be without a locking pin. As shown in FIG. 8A, the range of motion of the door is very wide. In contrast, FIG. 8B illustrates an example of how a locking pin can limit, secure, and/or lock a door into a particular position (e.g., slightly ajar, slightly open).

Figure 9:
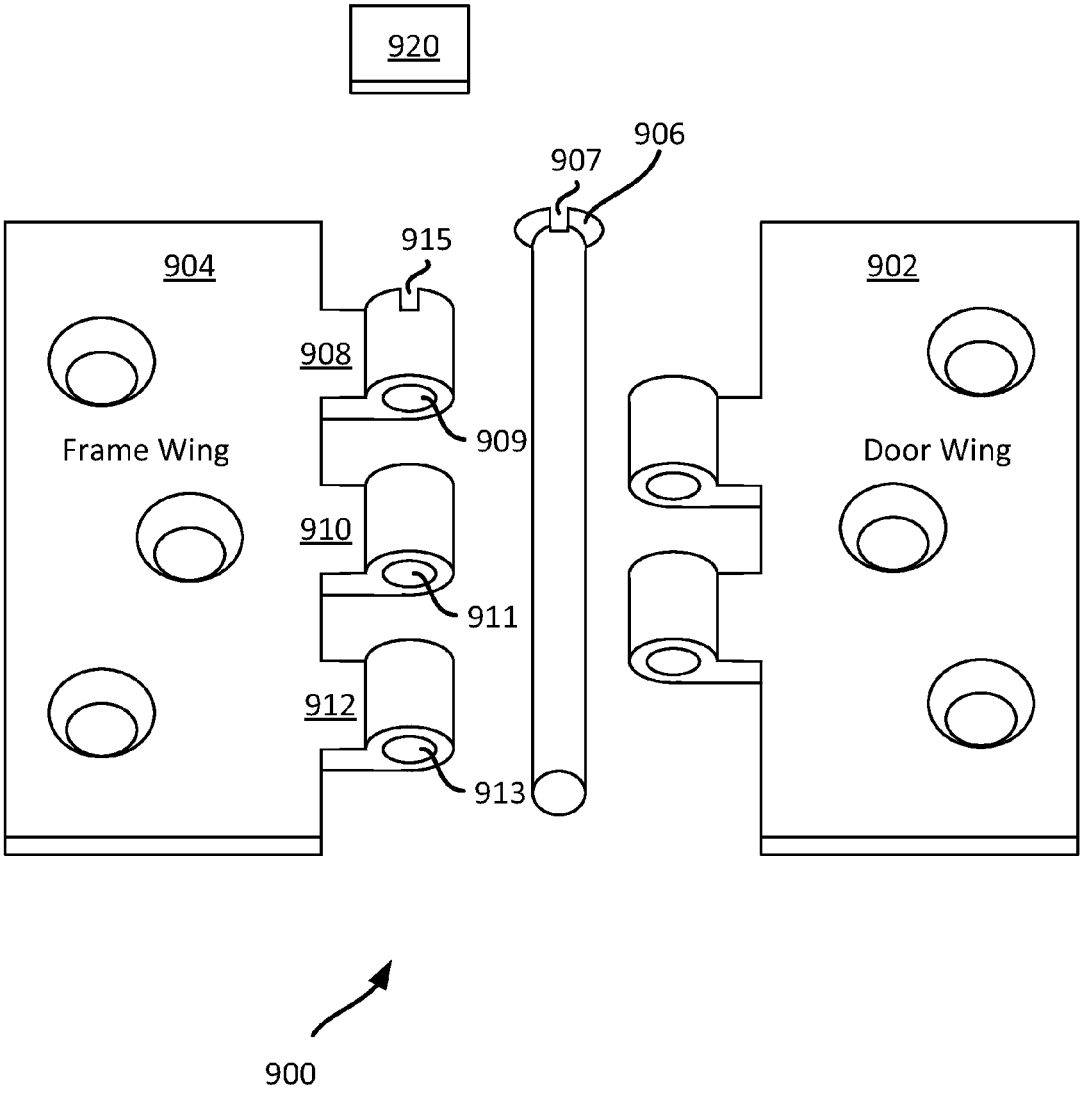
FIG. 9 illustrates another example of a modified hinge/hinge assembly that includes a mechanism for limiting the range/movement of a door.

FIG. 9 illustrates another example of a modified hinge/hinge assembly that includes a mechanism for limiting the range/movement of a door in some implementations. As shown in FIG. 9, the hinge/hinge assembly 900 includes a first wing 902, a second wing 904, a pin 906, and a slab 920.

In some implementations, the first wing 902 is a door wing that is coupled to a door. In some implementations, the second wing 904 is a frame wing that is coupled to a frame. The second wing 904 is coupled to a first knuckle 908, a second knuckle 910, and a third knuckle 912. The first knuckle 908 includes a first hole 909 that traverses through a first direction (e.g., along the longitudinal direction) in the first knuckle 908. The first knuckle 908 includes a trench 915 on the top portion of the first knuckle 908. The second knuckle 910 includes a second hole 911 that traverses through the first direction (e.g., along the longitudinal direction) in the second knuckle 910. The third knuckle 912 includes a third hole 913 that traverses through the first direction (e.g., along the longitudinal direction) in the third knuckle 912.

In some implementations, the pin 906 is a coupling pin that couples the first wing 902 with the second wing 904. The top portion of the 906 includes a trench 907.

To lock, secure, and/or limit the range of how much a door can be opened, slab 920 may be used. Specifically, in some implementations, the slab 920 (which may be part of the hinge/hinge assembly 900), is aligned with the trench 915 and the trench 907. When the slab 920 is inserted in the trenches 907 and 915, the slab 920 may prevent the door from fully opening (e.g., 90 degree open), since the slab 920 may hit a frame/wall as the door is opened and the slab 920 pivots towards the frame/wall. In some implementations, the length of the slab 920 and/or the angle at which the slab 920 (e.g., angles of the trenches 907 and 915) is coupled to the hinge 900 will determine how much a door can be opened.

Figure 10:
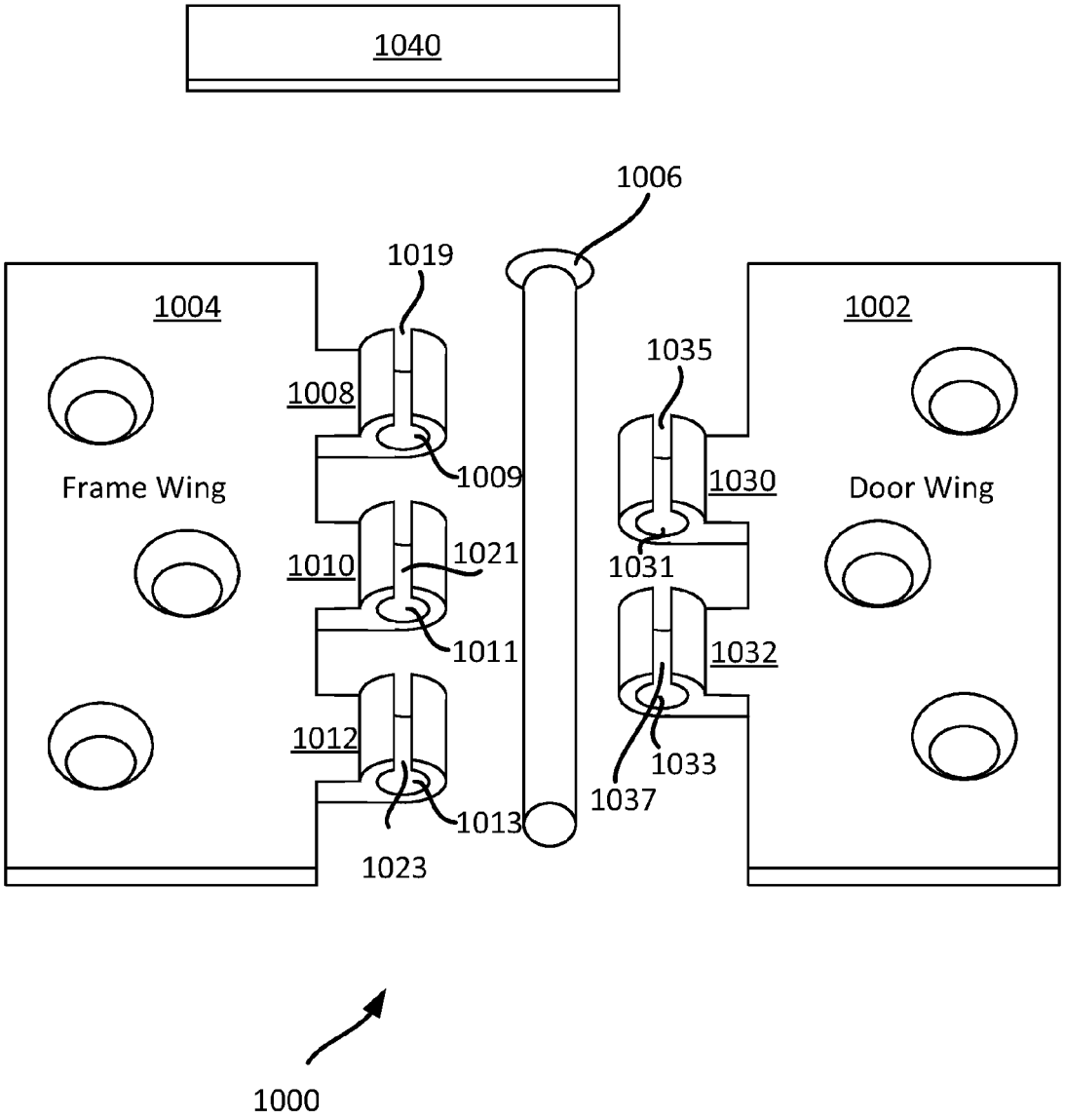
FIG. 10 illustrates another example of a modified hinge/hinge assembly that includes a mechanism for limiting the range/movement of a door.

FIG. 10 illustrates another example of a modified hinge/hinge assembly that includes a mechanism for limiting the range/movement of a door in some implementations. As shown in FIG. 10, the hinge/hinge assembly 1000 includes a first wing 1002, a second wing 1004, a pin 1006, and a slab 1020.

In some implementations, the first wing 1002 is a door wing that is coupled to a door. In some implementations, the second wing 1004 is a frame wing that is coupled to a frame. The second wing 1004 is coupled to a first knuckle 1008, a second knuckle 1010, and a third knuckle 1012. The first knuckle 1008 includes a first hole 1009 that traverses through a first direction (e.g., along the longitudinal direction) in the first knuckle 1008. The first knuckle 908 also includes a first cavity 1019 that traverses through the first direction. The second knuckle 1010 includes a second hole 1011 that traverses through the first direction (e.g., along the longitudinal direction) in the second knuckle 1010. The second knuckle 1008 also includes a second cavity 1021 that traverses through the first direction. The third knuckle 1012 includes a third hole 1013 that traverses through the first direction (e.g., along the longitudinal direction) in the third knuckle 1012. The third knuckle 1012 also includes a third cavity 1023 that traverses through the first direction.

The first wing 1002 is coupled to a fourth knuckle 1030 and a fifth knuckle 1032. The fourth knuckle 1030 includes a fourth hole 1031 that traverses through a first direction (e.g., along the longitudinal direction) in the fourth knuckle 1030. The fourth knuckle 1030 also includes a fourth cavity 1035 that traverses through the first direction. The fifth knuckle 1032 includes a fifth hole 1033 that traverses through the first direction (e.g., along the longitudinal direction) in the fifth knuckle 1032. The fifth knuckle 1032 also includes a fifth cavity 1037 that traverses through the first direction.

In some implementations, the pin 1006 is a coupling pin that couples the first wing 1002 with the second wing 1004.

To lock, secure, and/or limit the range of how much a door can be opened, slab 1040 may be used. Specifically, in some implementations, the slab 1040 (which may be part of the hinge/hinge assembly 1000), is aligned with one or more cavities (e.g., cavities 1019, 1021, 2023, 1035, 1037). In some implementations, when the slab 1040 is inserted in one or more of the cavities, the slab 1040 may lock the door to a particular position. In some implementations, when the slab 1040 is inserted in one or more of the cavities, the slab 1040 may prevent the door from fully opening (e.g., 90 degree open), since the slab 1040 may hit a frame/wall as the door is opened and the slab 1040 pivots towards the frame/wall. The slab 1040 may be a magnetic slab. Different slabs may have different shapes.

Figure 11A:
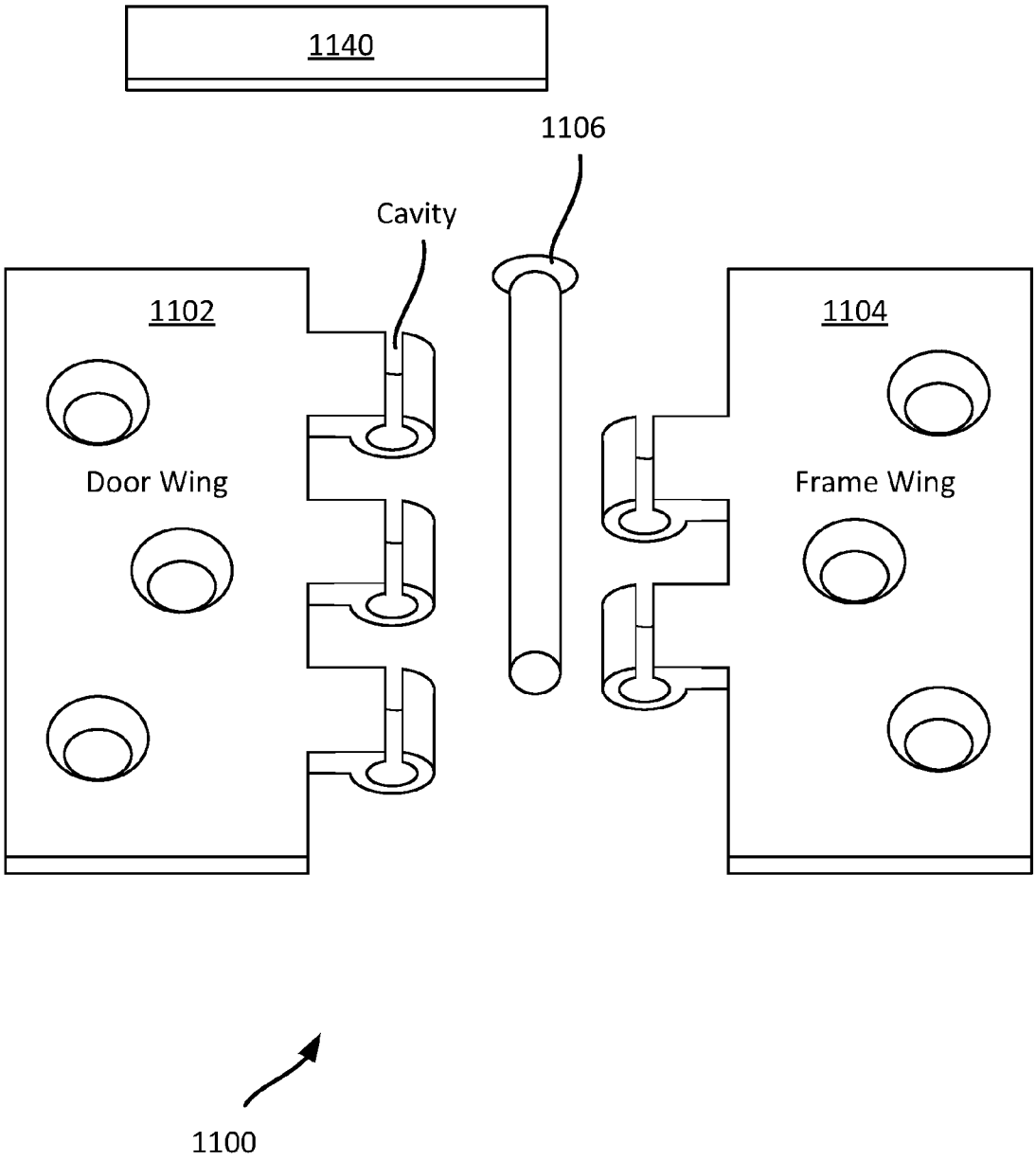
FIG. 11 illustrates an example of a modified hinge/hinge assembly that includes a mechanism for limiting the range/movement of a door.
Figure 11B:
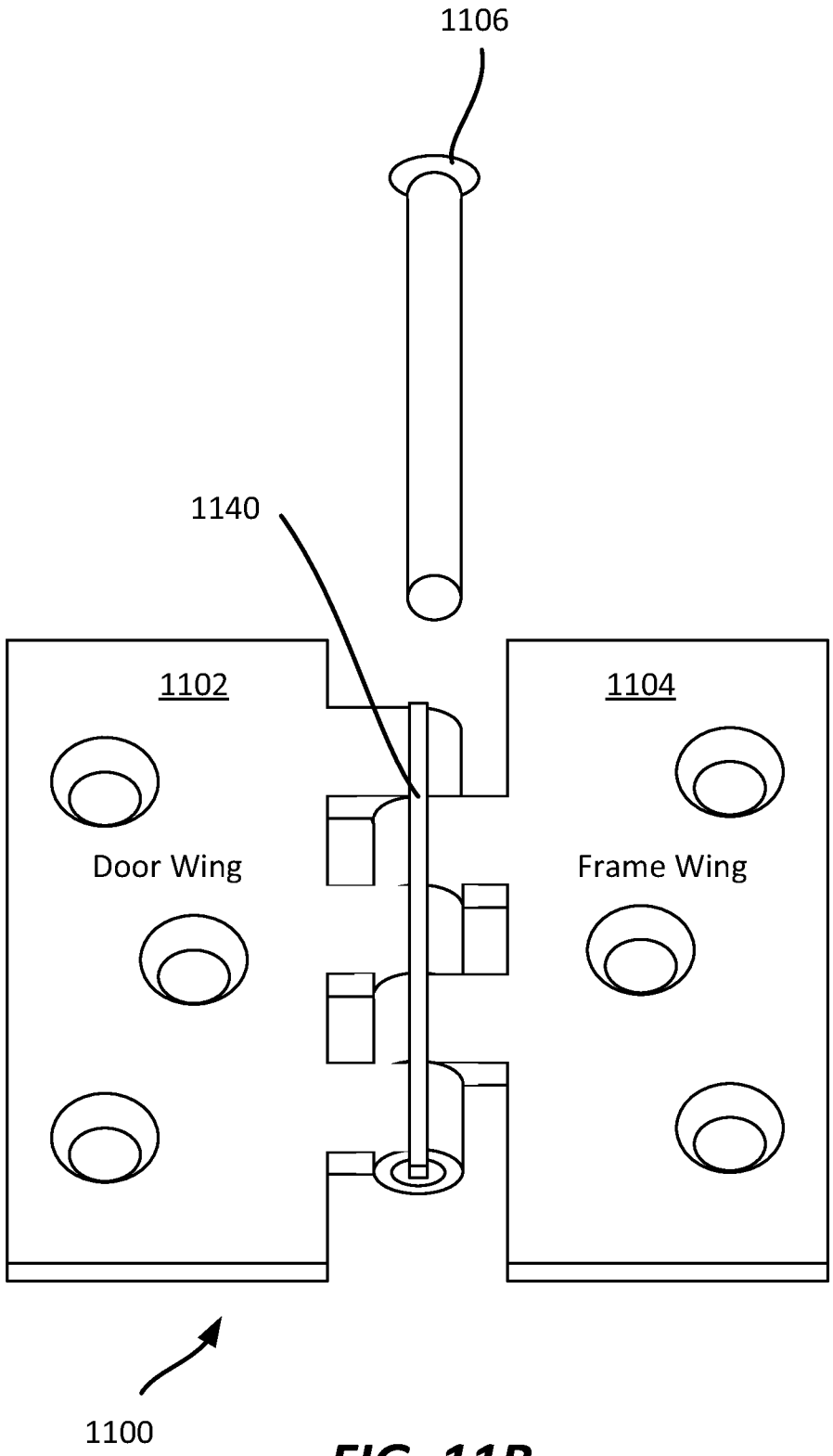

Different implementations may have different positions for the cavities. FIG. 11A illustrates an example of a hinge/hinge assembly that includes cavities in different positions. In some implementations, the hinge/hinge assembly 1100 of FIG. 11A operates in a similar manner as the hinge/hinge assembly 1000 of FIG. 10. FIG. 11B illustrates the slab 1140 coupled to one or more of the cavities in the knuckles of the wings (e.g., wings 1102-1104). The slab 1140 may be a magnetic slab. Different slabs may have different shapes.

Although FIGS. 10 and 11A-11B illustrate cavities that traverse along the length (e.g., longitudinal) of the knuckles and/or hinge assembly, in some implementations, the cavities can be replaced with trenches/slots that traverse along the length (e.g., longitudinal) of the knuckles and/or hinge assembly. One advantage of using trenches/slots is that each knuckle can have multiple trenches that traverse along the length (e.g., longitudinal) of the knuckles, which would allow the hinge assembly to be locked in multiple, various positions.

Figure 12A:
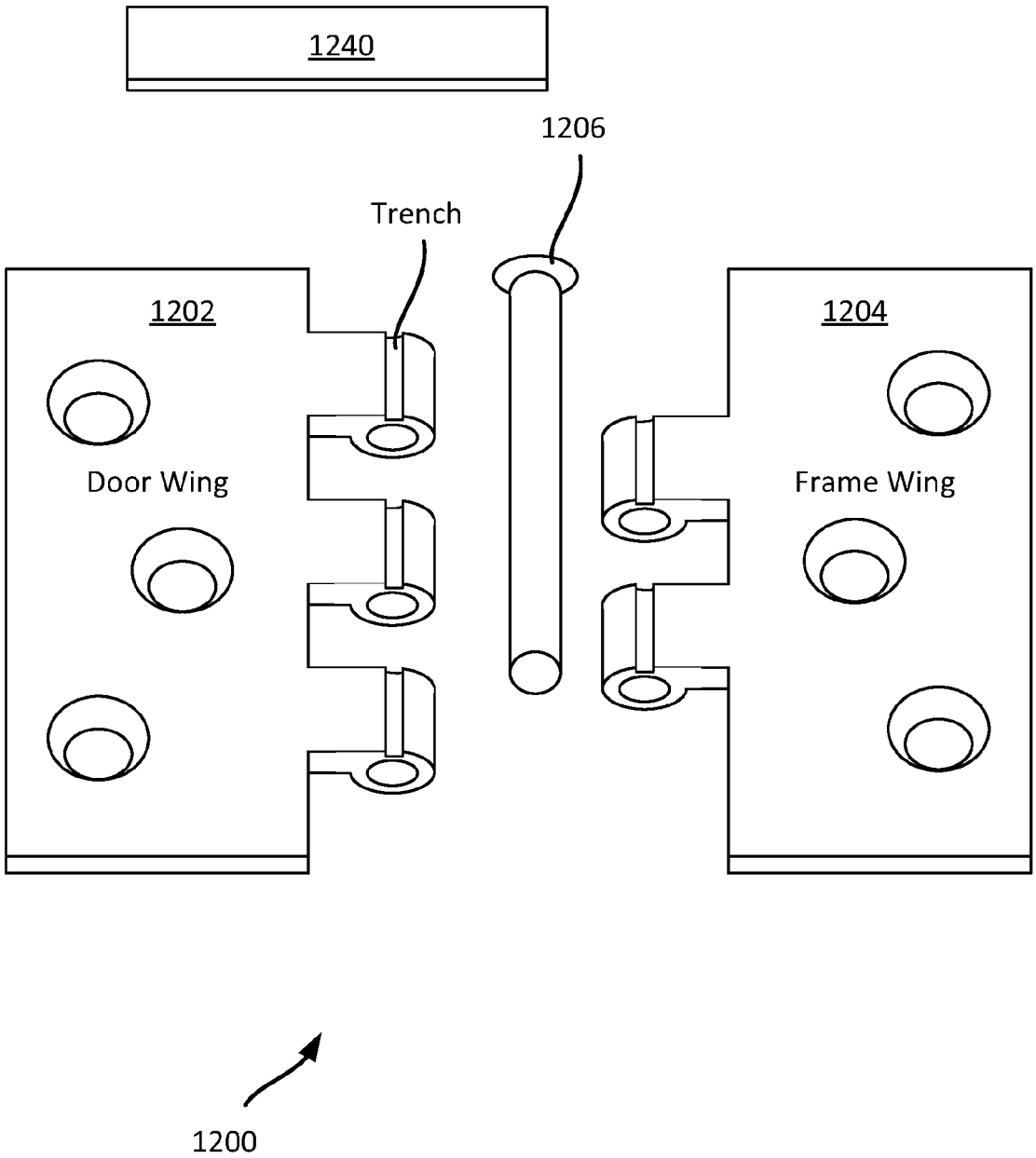
FIG. 12A illustrates an example of hinge/hinge assembly that includes various trenches/slots that traverse along the length of the knuckles.
Figure 12B:
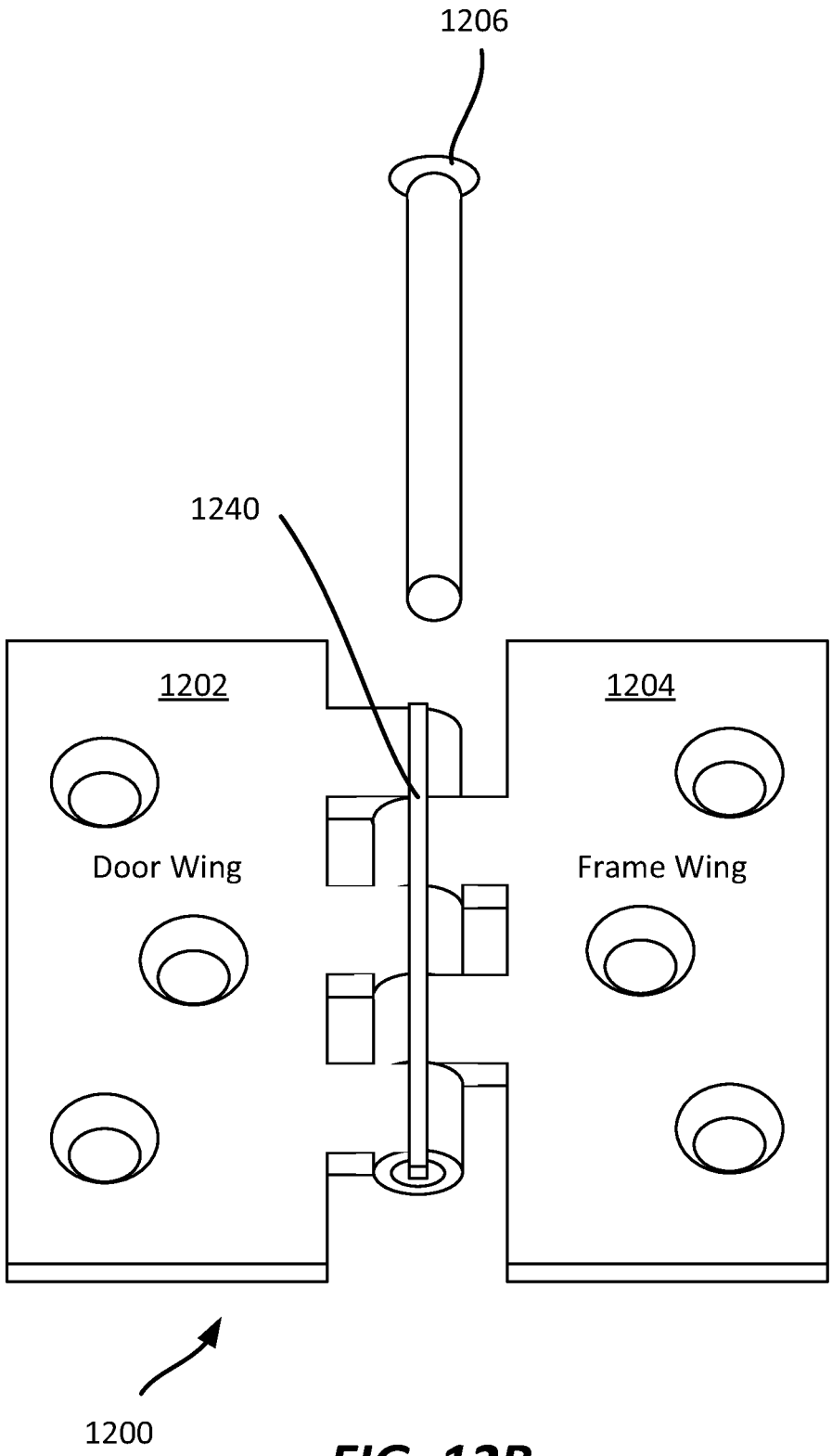
FIG. 12B illustrates an example of hinge/hinge assembly that includes various trenches/slots that traverse along the length of the knuckles.

FIGS. 12A-12B illustrate an example of hinge/hinge assembly that includes various trenches/slots that traverse along the length of the knuckles. FIG. 12B illustrates the slab 1240 coupled to one or more of the trenches in the knuckles of the wings (e.g., wings 1202-1204). The slab 1240 may be a magnetic slab. Although the knuckle is shown with one trench/slot, in some implementations, one or more of the knuckles may have more than one trench/slot. Different implementations may have different positions, locations, and/or angles for the trench/slot in the knuckles.

Figure 13:
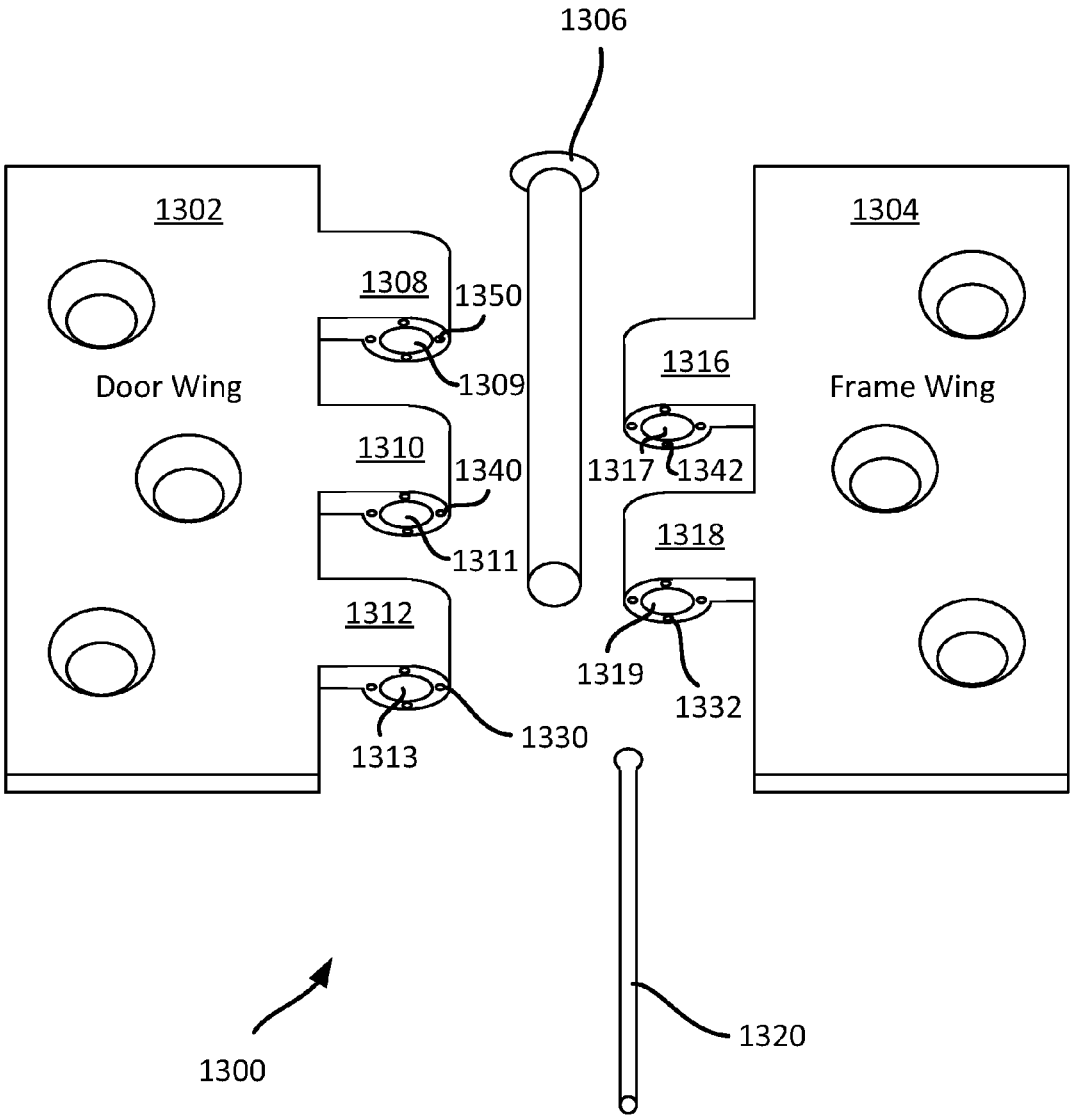
FIG. 13 illustrates another example of a modified hinge/hinge assembly that includes a mechanism for limiting the range/movement of a door.

FIG. 13 illustrates another example of a modified hinge/hinge assembly that includes a mechanism for limiting the range/movement of a door in some implementations. As shown in FIG. 13, the hinge/hinge assembly 1300 includes a first wing 1302, a second wing 1304, a first pin 1306, and a second pin 1308.

In some implementations, the first wing 1302 is a door wing that is coupled to a door. The first wing 1302 is coupled to a first knuckle 1308, a second knuckle 1310, and a third knuckle 1312. The first knuckle 1308 includes a first hole 1309 that traverses through a first direction (e.g., along the longitudinal direction) in the first knuckle 1308. The second knuckle 1310 includes a second hole 1311 that traverses through the first direction (e.g., along the longitudinal direction) in the second knuckle 1310. The third knuckle 1312 includes a third hole 1313 that traverses through the first direction (e.g., along the longitudinal direction) in the third knuckle 1312. As shown in FIG. 13, each of the first, second and third knuckles 1308, 1310 and 1312 includes several holes (e.g., hole 1330, 1340, 1350) that traverse along the first direction (e.g., length) of the knuckles.

In some implementations, the second wing 1304 is a frame wing that is coupled to a frame. The second wing 1304 is coupled to a fourth knuckle 1316 and a fifth knuckle 1318. The fourth knuckle 1316 includes a fourth hole 1317 that traverses through a first direction (e.g., along the longitudinal direction) in the fourth knuckle 1316. The fifth knuckle 1318 includes a fifth hole 1319 that traverses through the first direction (e.g., along the longitudinal direction) in the fifth knuckle 1318. As further shown in FIG. 13, each of the fourth and fifth knuckles 1316 and 1318 include several locking holes (e.g., hole 1332, 1342) that traverse along the first direction (e.g., length) of the knuckles.

In some implementations, the pin 1306 is a coupling pin that couples the first wing 1302 with the second wing 1304. Specifically, the pin 1306 couples the first and second wings 1302-304 by traversing through the holes 1308, 1316, 1310 and 1318 in some implementations. However, in some implementations, the pin 1306 may traverse more or less holes. In some implementations, the pin 1306 may include one or more holes (not shown). Examples of holes in a pin will be further described below.

To lock, secure, and/or limit the range of how much a door can be opened, a second pin 1320 may be used. Specifically, in some implementations, the second pin 1320 (which may be part of the hinge/hinge assembly 1300), is inserted in the holes (e.g., holes 1330, 1332, 1340, 1342, 1350) to limit the range of how much a door can be opened. In some implementations, when the second pin 1320 is inserted in one or more of the holes (e.g., holes 1330-1332, 1340-1342, 1350), the second pin 1320 (e.g., locking pin) may lock the door to a particular position. In some implementations, inserting the second pin 1320 in different holes will lock the door in different positions.

Figure 14:
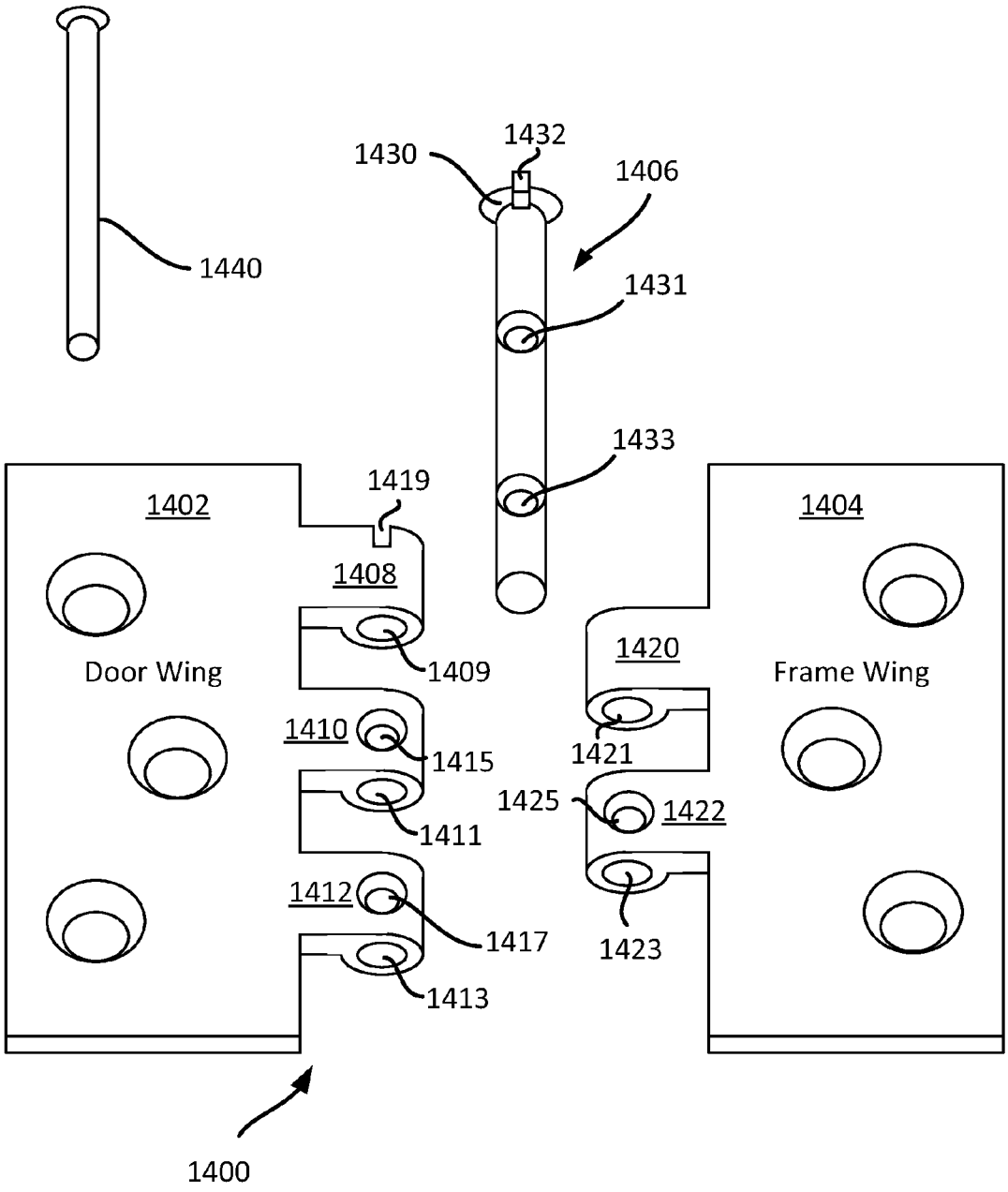
FIG. 14 illustrates another example of a modified hinge/hinge assembly that includes a mechanism for limiting the range/movement of a door.

As previously described, in the some implementations, the coupling pin may have one or more holes. FIG. 14 illustrates yet another example of a modified hinge/hinge assembly that includes a mechanism for limiting the range/movement of a door in some implementations. As shown in FIG. 14, the hinge/hinge assembly 1400 includes a first wing 1402, a second wing 1404, a first pin 1406, and a second pin 1440.

In some implementations, the first wing 1402 is a door wing that is coupled to a door. The first wing 1402 is coupled to a first knuckle 1408, a second knuckle 1410, and a third knuckle 1412. The first knuckle 1408 includes a first hole 1409 that traverses through a first direction (e.g., along the longitudinal direction) in the first knuckle 1408. The first knuckle 1408 also includes a trench 1419 on the top portion of the first knuckle 1408. The second knuckle 1410 includes a second hole 1411 that traverses through the first direction (e.g., along the longitudinal direction) in the second knuckle 1410. The second knuckle 1410 also includes another second hole 1415 that traverse through a second direction (e.g., along lateral direction) in the second knuckle 1410. The third knuckle 1412 includes a third hole 1413 that traverses through the first direction (e.g., along the longitudinal direction) in the third knuckle 1412. The third knuckle 1412 also includes another third hole 1417 that traverses through the second direction (e.g., along lateral direction) in the third knuckle 1412. The second direction is different than the first direction.

In some implementations, the second wing 1404 is a frame wing that is coupled to a frame. The second wing 1404 is coupled to a fourth knuckle 1420 and a fifth knuckle 1422. The fourth knuckle 1420 includes a fourth hole 1421 that traverses through a first direction (e.g., along the longitudinal direction) in the fourth knuckle 1420. The fifth knuckle 1422 includes a fifth hole 1423 that traverses through the first direction (e.g., along the longitudinal direction) in the fifth knuckle 1422. The fifth knuckle 1422 also includes another fifth hole 1425 that traverses through a second direction (e.g., along lateral direction) in the third knuckle 1422.

In some implementations, the pin 1406 is a coupling pin that couples the first wing 1402 with the second wing 1404. Specifically, the pin 306 couples the first and second wings 1402-1304 by traversing through the holes 1409, 1420, 1411 and 1421 in some implementations. However, in some implementations, the pin 306 may traverse more or less holes. As further shown in FIG. 14, the pin 1406 includes a first hole 1431 and a second hole 1433. Different implementations may have different number of holes. In addition, the position, location and/or angle of the holes may be different with different implementations.

To lock, secure, and/or limit the range of how much a door can be opened, a second pin 1440 may be used. Specifically, in some implementations, the second pin 1440 (which may be part of the hinge/hinge assembly 1400), is inserted in one or more of the locking holes (e.g., holes 1431, 1433, 1415, 1413, 1422) to limit the range of how much a door can be opened. In some implementations, when the second pin 1440 is inserted in one or more of the locking holes (e.g., holes 1431, 1433, 1415, 1413, 1422), the second pin 1440 (e.g., locking pin) may lock the door to a particular position. In some implementations, inserting the second pin 1440 in different holes will lock the door in different positions.

FIG. 14 also includes a cap 1430 that is coupled to the pin 1406. The cap 1430 includes a protrusion 1432 that may be coupled to a trench/slot (not visible) in the pin 1406, as well as the trench 1419 in the first knuckle 1408. In some implementations, the cap 1430 prevents the pin 1406 from pivoting relative to the first wing 1402.

Figure 15:
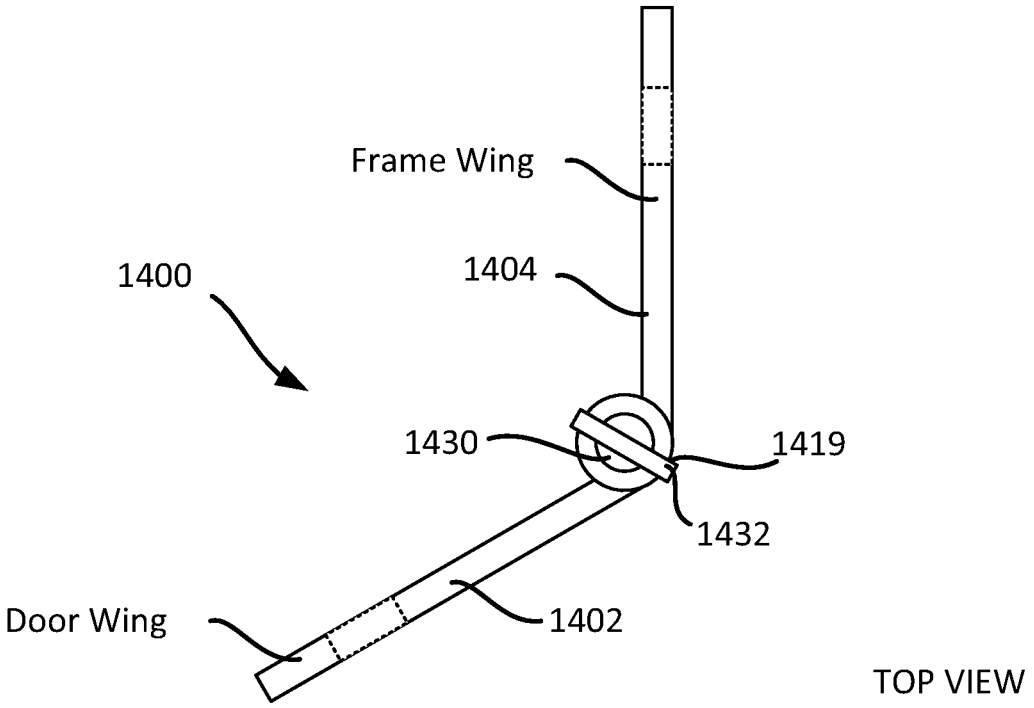
FIG. 15 illustrates a plan view of a hinge/hinge assembly.

FIG. 15 illustrates a plan view (e.g., top view) of the hinge/hinge assembly of FIG. 14. As shown in FIG. 15, the hinge/hinge assembly 1400 includes a first wing 1402 and a second wing 1404. The first wing 1402 is a door wing that is coupled to the second 1404 (which may be a frame wing) by a pin 1406. A cap 1430 is coupled to the pin 1406. The cap 1430 includes a protrusion 1432 that may be coupled to a trench/slot (not visible) in the pin 1406, as well as the trench 1419 in the first knuckle 1408. In some implementations, the cap 1430 prevents the pin 1406 from pivoting relative to the first wing 1402.

Figure 16:
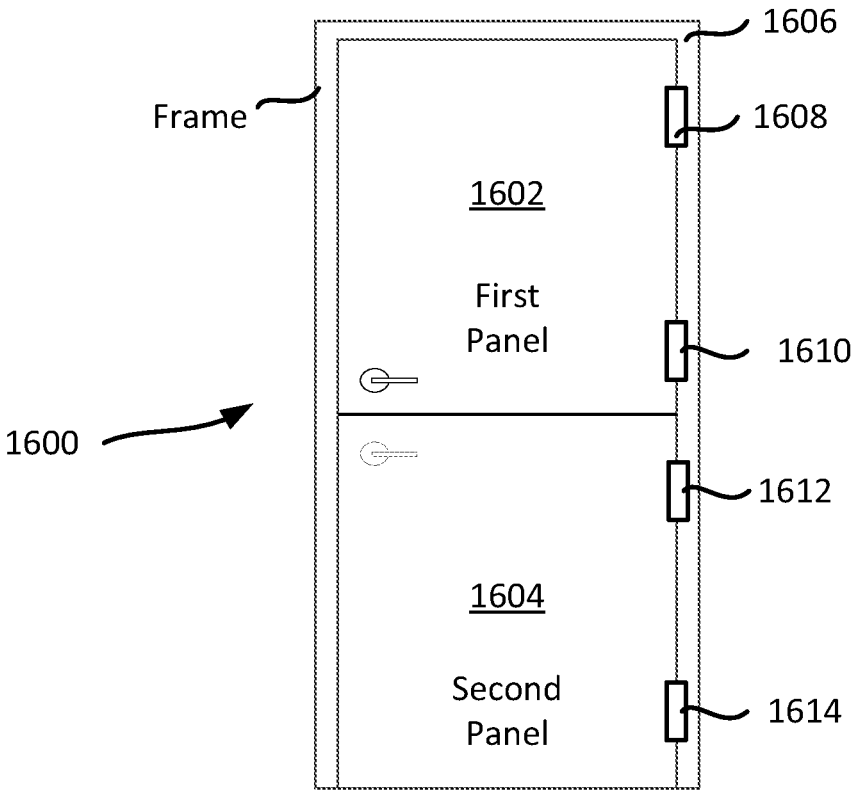
FIG. 16 illustrates an example of a door that one or more of the hinge/hinge assembly.

The hinge/hinge assembly described in the present disclosure may be used in different window implementations, door implementations and/or configurations. FIG. 16 illustrates an example of a door that one or more of the hinge/hinge assembly described in the present application may be used. Specifically, FIG. 16 illustrates a configuration 1600 that includes a first door panel 1602, a second door panel 1604. The first door panel 1602 is coupled to a frame 1606 through a first hinge 1608 and a second hinge 1610. The second door panel 1604 is coupled to the frame 1608 through a third hinge 1612 and a fourth hinge 1614. In some implementations, the first, second, third and fourth hinges 1608-1614 may be any of the hinges described in the present disclosure. Different implementations may use different combination of hinges. Although FIG. 16 illustrates hinges being used in a door. In some implementations, the hinges in the present disclosure may also be used in windows.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art. For example, in some implementations, one or more of the knuckles of one or more wings may include a combination of holes and trenches/slots. Moreover, the use of the term "hole" should not be limited to a particular size and/or shape of a hole. A hole can be a cavity with any size and/or shape.

The invention claimed is:

1. A hinge comprising:
a first wing comprising:
a first knuckle comprising a first hole;
a second knuckle comprising a second hole and a first locking hole; and
a fifth knuckle comprising a fifth hole;
a second wing comprising;
a third knuckle comprising a third hole; and
a fourth knuckle comprising a fourth hole and a second locking hole;
a coupling pin configured to couple the first wing to the second wing through the first knuckle, the second knuckle, the third knuckle, and the fourth knuckle; and
a locking pin configured to limit the hinge in a particular position when the locking pin is inserted into the first locking hole of the second knuckle.

2. The hinge of claim 1, wherein the locking pin is configured to lock the hinge in a particular position when the locking pin is inserted into the first locking hole of the second knuckle.

3. The hinge of claim 1, wherein the first wing is a door wing and the second wing is a frame wing.

4. The hinge of claim 1, wherein the coupling pin includes at least one locking hole.

5. The hinge of claim 1, wherein the locking pin comprises a first protrusion and a second protrusion, the first protrusion configured to be inserted in the first locking hole, the second protrusion configured to be inserted in the second locking hole.

6. The hinge of claim 1, wherein the locking pin is configured to limit the hinge in a second particular position when the locking pin is inserted into the second locking hole of the fourth knuckle.

7. The hinge of claim 1, wherein the locking pin is configured to lock the hinge in a second particular position when the locking pin is inserted into the second locking hole of the fourth knuckle.

8. The hinge of claim 1, wherein the first locking hole is at a first angle in the second knuckle, and the second locking hole is at a second angle in the fourth knuckle.

9. A hinge comprising:
a first wing comprising:
a first knuckle comprising a first hole and a first slot; and
a second knuckle comprising a second hole and a second slot;
a second wing comprising:
a third knuckle comprising a third hole and a third slot; and
a fourth knuckle comprising a fourth hole;
a coupling pin configured to couple the first wing to the second wing through the first knuckle, the second knuckle, the third knuckle, and the fourth knuckle; and
a locking slab configured to limit the hinge in a particular position when the locking slab is inserted into the first slot of the first knuckle.

10. The hinge of claim 9, wherein the locking slab is configured to lock the hinge in a particular position when the locking slab is inserted into the first slot of the first knuckle.

11. The hinge of claim 9, wherein the first wing is a door wing and the second wing is a frame wing.

12. The hinge of claim 9, wherein the locking slab is configured to lock the hinge in a particular position when the locking slab is inserted into the first slot, the second slot and the third slot.

13. The hinge of claim 9, wherein the locking slab is configured to limit the hinge in a second particular position when the locking slab is inserted into the second slot of the second knuckle.

14. The hinge of claim 9, wherein the locking slab is configured to lock the hinge in a second particular position when the locking slab is inserted into the second slot of the second knuckle.

15. The hinge of claim 9, wherein the locking slab is configured to lock the hinge in a particular position when the locking slab is inserted into the first slot of the first knuckle and the second slot of the second knuckle.

16. The hinge of claim 9, wherein the first slot is at a first angle in the first knuckle, and the second slot is at a second angle in the second knuckle.

17. The hinge of claim 9, wherein the locking slab is a magnetic slab.

18. A hinge comprising:
a first wing comprising:
a first knuckle comprising a first hole and a first slot; and
a second knuckle comprising a second hole;
a second wing comprising:
a third knuckle comprising a third hole; and
a fourth knuckle comprising a fourth hole;
a coupling pin comprising a pin slot, wherein the coupling pin is configured to couple the first wing to the second wing through the first knuckle, the second knuckle, the third knuckle, and the fourth knuckle; and
a locking slab configured to limit the hinge in a particular position when the locking slab is inserted into the first slot of the first knuckle and the pin slot of the coupling pin.

19. A hinge comprising:
a first wing comprising:
a first knuckle comprising a first hole and a first slot; and
a second knuckle comprising a second hole;
a second wing comprising:
a third knuckle comprising a third hole; and
a fourth knuckle comprising a fourth hole;
a coupling pin comprising at least one locking hole, wherein the coupling pin is configured to couple the first wing to the second wing through the first knuckle, the second knuckle, the third knuckle, and the fourth knuckle; and
a locking slab configured to limit the hinge in a particular position when the locking slab is inserted into the first slot of the first knuckle.

* * * * *